US008342091B2

(12) United States Patent
Bourgeois

(10) Patent No.: US 8,342,091 B2
(45) Date of Patent: Jan. 1, 2013

(54) EXPENDABLE INK CARTRIDGE FOR HAND HELD PRINTING MECHANISM

(76) Inventor: William Bourgeois, San Diego, CA (US)

( * ) Notice: Subject to any disclaimer, the term of this patent is extended or adjusted under 35 U.S.C. 154(b) by 46 days.

(21) Appl. No.: 12/755,323

(22) Filed: Apr. 6, 2010

(65) Prior Publication Data

US 2010/0258013 A1 Oct. 14, 2010

Related U.S. Application Data

(63) Continuation of application No. 11/285,655, filed on Nov. 22, 2005, now Pat. No. 7,698,998.

(51) Int. Cl.
*B41F 31/00* (2006.01)
*B41F 31/24* (2006.01)

(52) U.S. Cl. ..... 101/335; 101/364; 101/327; 101/333

(58) Field of Classification Search ..... 101/35, 101/41, 42, 4, 9, 103, 105, 109, 111, 327, 101/333, 405, 406, 335, 359, 364; *B41F 17/10*
See application file for complete search history.

(56) References Cited

U.S. PATENT DOCUMENTS

| | | | | |
|---|---|---|---|---|
| 2,983,219 | A * | 5/1961 | Weissman | 101/103 |
| 3,052,180 | A | 9/1962 | Ackerman et al. | |
| 3,196,780 | A | 7/1965 | Ernest et al. | |
| 3,241,482 | A * | 3/1966 | Keck | 101/103 |
| 3,244,097 | A | 4/1966 | McRae et al. | |
| 4,239,399 | A | 12/1980 | Johnstun et al. | |
| 4,746,936 | A | 5/1988 | Takahashi | |
| 4,758,849 | A | 7/1988 | Piatt et al. | |
| 4,934,564 | A | 6/1990 | Piatt | |
| 5,044,791 | A | 9/1991 | Lawson | |
| 5,160,943 | A | 11/1992 | Pettigrew | |
| 5,446,559 | A | 8/1995 | Birk | |
| 5,634,730 | A | 6/1997 | Bobry | |
| 5,988,900 | A | 11/1999 | Bobry | |
| 5,995,123 | A | 11/1999 | McCormick | |
| 6,062,686 | A | 5/2000 | Kinoshita et al. | |
| 6,406,121 | B1 | 6/2002 | Benjamin et al. | |
| 6,499,840 | B2 | 12/2002 | Day | |
| 6,526,882 | B1 * | 3/2003 | Shih | 101/327 |
| 6,543,893 | B2 | 4/2003 | Desormeaux | |
| 6,698,952 | B1 | 3/2004 | Goddard | |

FOREIGN PATENT DOCUMENTS

| | | |
|---|---|---|
| JP | 60120089 | 6/1985 |
| JP | 10044066 | 2/1988 |

* cited by examiner

*Primary Examiner* — Leslie J Evanisko
(74) *Attorney, Agent, or Firm* — Fred C. Hernandez; Mintz, Levin, Cohn, Ferris, Glovsky and Popeo, P.C.

(57) ABSTRACT

A portable cable marking mechanism includes a gun-like housing with a pivotally mounted trigger assembly for moving a stamping unit along a predetermined inking path to engage in sequence an inking pad of a replaceable ink cartridge for inking the stamping unit and then a cable sleeve for providing the cable sleeve with customized indicia markings.

4 Claims, 12 Drawing Sheets

EXPENDABLE INK CARTRIDGE FOR HAND HELD PRINTING MECHANISM

CROSS-REFERENCE TO RELATED APPLICATIONS

This application is a continuation of U.S. patent application Ser. No. 11/285,655, filed Nov. 22, 2005, now U.S. Pat. No. 7,698,998, entitled "Portable Electrical Conductor Marking Mechanism and Method of Using Same." Priority of the aforementioned filing date is hereby claimed, and the disclosure of the patent application is hereby incorporated by reference in its entirety.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

Technical Field

In home and office constructions, it is often necessary to add wiring for alarm and cable systems during and after the home and office constructions have been completed. Many such wiring situations require the pulling of multiple strands of wire, often having the same wire gauge and wire color. In such situations it would be highly desirable to have a new and improved apparatus and method of marking such wires so they can be easily identified from one another for attachment to components and sub panels, whichever the case may be.

BRIEF SUMMARY OF THE INVENTION

A portable cable marking mechanism includes a gun-like housing with a pivotally mounted trigger assembly for moving a stamping unit along a predetermined inking path to engage in sequence an inking pad of a replaceable ink cartridge unit for inking the stamping unit and then a cable sleeve for providing the cable sleeve with customized indicia markings.

DETAILED DESCRIPTION OF THE PREFERRED EMBODIMENTS

Figure 1:
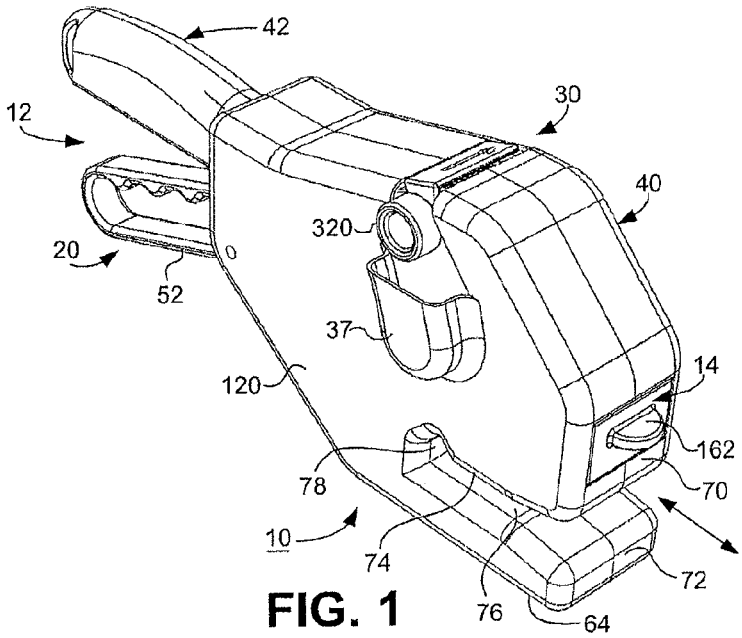
FIG. 1 is a diagrammatic view of a portable wire stamping gun, which is constructed in accordance with an embodiment of the present invention.
Figure 2:
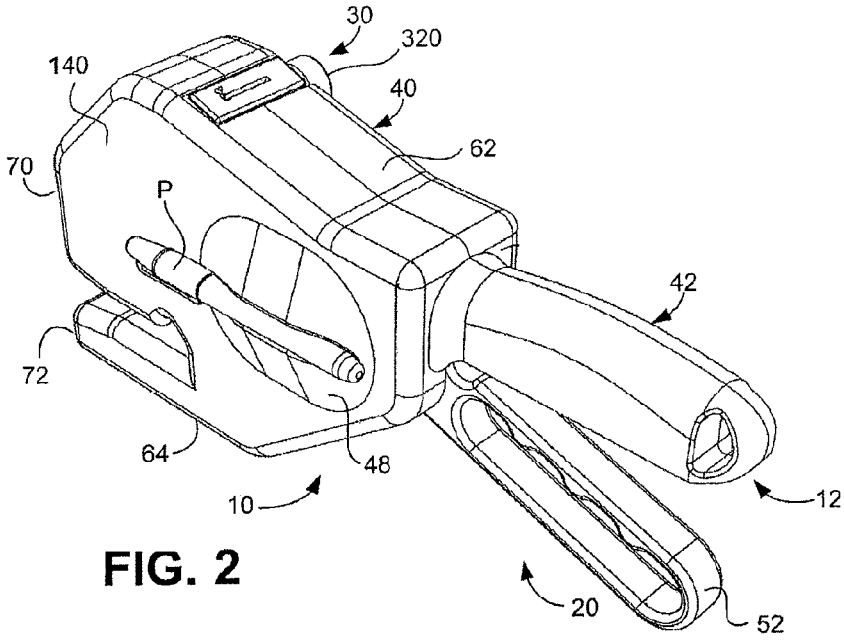
FIG. 2 is another diagrammatic view of the portable wire stamping gun of FIG. 1 as seen from its opposite side illustrating an attached removable marking pen.
Figure 3:
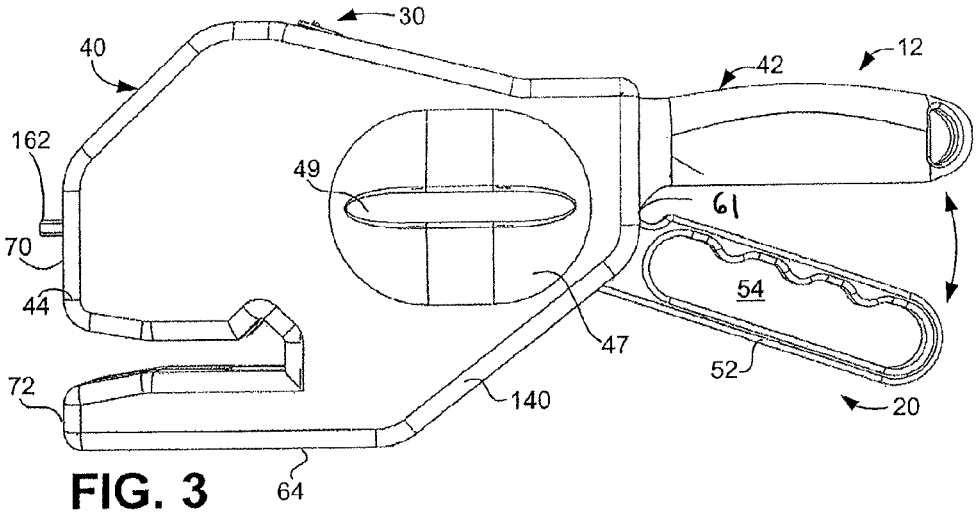
FIG. 3 is a right side elevation view of the portable wire stamping gun of FIG. 1, with the marking pen removed.
Figure 4:
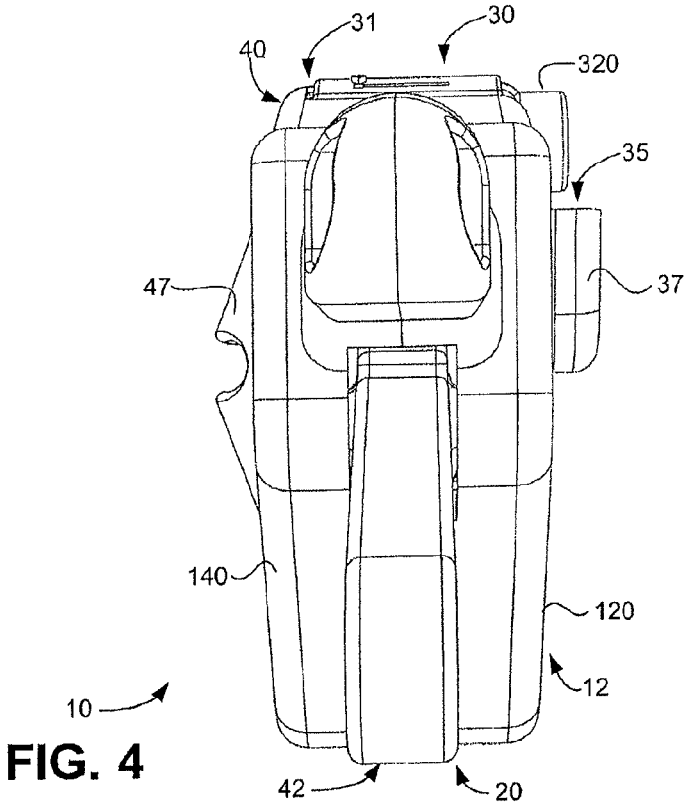
FIG. 4 is a rear elevation view of the portable wire stamping gun of FIG. 3.

An portable cable marking mechanism or wire stamping gun and method of using the mechanism for marking a cable or wire sleeve is disclosed. The following description is presented to enable any person skilled in the art to make and use the invention. For purposes of explanation, specific nomenclature is set forth to provide a thorough understanding of the present invention. Descriptions of specific applications and methods are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and steps disclosed herein.

The Portable Marking Mechanism

Referring now to the drawings and more particularly to FIGS. 1-5, there is illustrated a portable electrical conductor marking mechanism or apparatus 10 which is constructed in accordance with a preferred embodiment of the present invention. The marking mechanism or apparatus 10 has a hand-gun like appearance, which allows wires and cables of different sizes and shapes to be stamped, in field, with customized indicia in a fast and convenient manner as will be explained hereinafter in greater detail.

Figure 10:
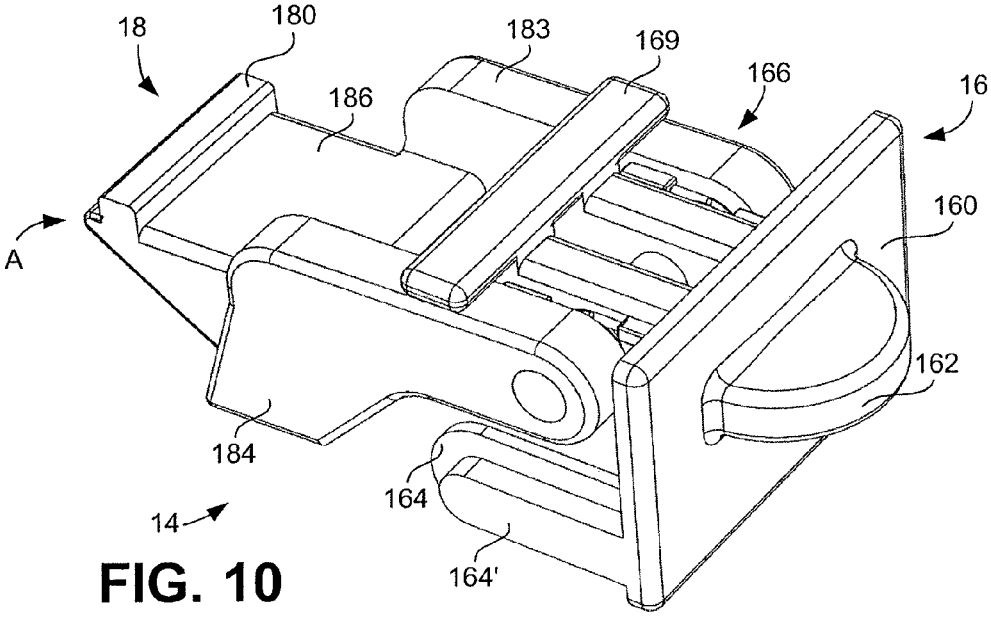
FIG. 10 is a diagrammatic illustration of an expendable ink cartridge assembly utilized in the portable wire stamping gun of FIG. 1.

As best seen in FIG. 1, the portable cable marking mechanism 10 generally includes a gun-like base unit housing or handle assembly 12, which supports an ink cartridge assembly 14 and a trigger assembly 20 (FIG. 15) which cooperate together to facilitate field stamping an electrical conductor, such as a cable or wire 11 (FIG. 20) with customized indicia. As will be explained hereinafter in greater detail, the ink cartridge assembly 14 includes an ink cartridge carriage unit 16 and an ink cartridge or inking unit 18 as best seen in FIG. 10.

Considering now the handle assembly 12 in greater detail with reference to FIGS. 1-4 and 14, the handle assembly 12 generally includes a body member 40 and an elongated handle or end-handle extension 42. The end-handle extension 42 extends rearwardly and away from the body member 40 so that the end-handle extension 42 may be easily grasped by the hand of a user. The handle assembly 12 is also structured so that the trigger assembly 20, which is pivotally mounted and supported for movement within the interior of the housing 12, may be grasped in the fingers of a user and pulled upwardly toward the end-handle extension 42 to facilitate the stamping of a cable or wire, such as the cable 11, as will be explained hereinafter in greater detail.

Figure 15:
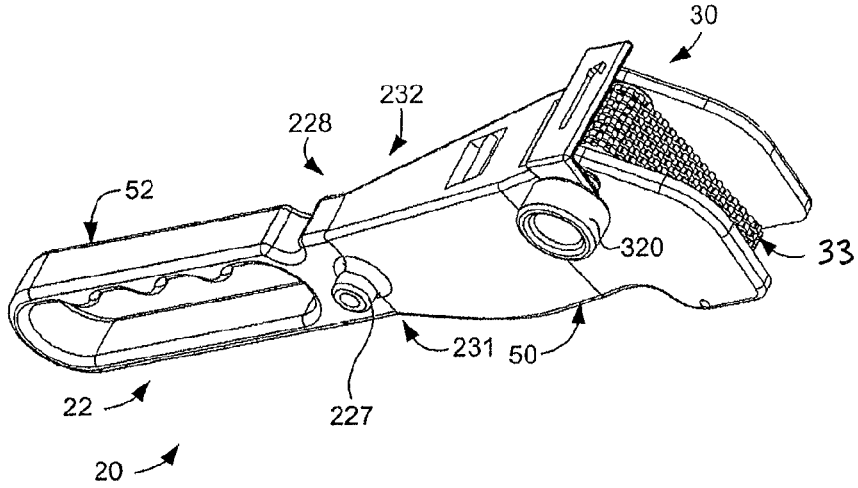
FIG. 15 is a diagrammatic illustration of a trigger assembly of FIG. 1.
Figure 16:
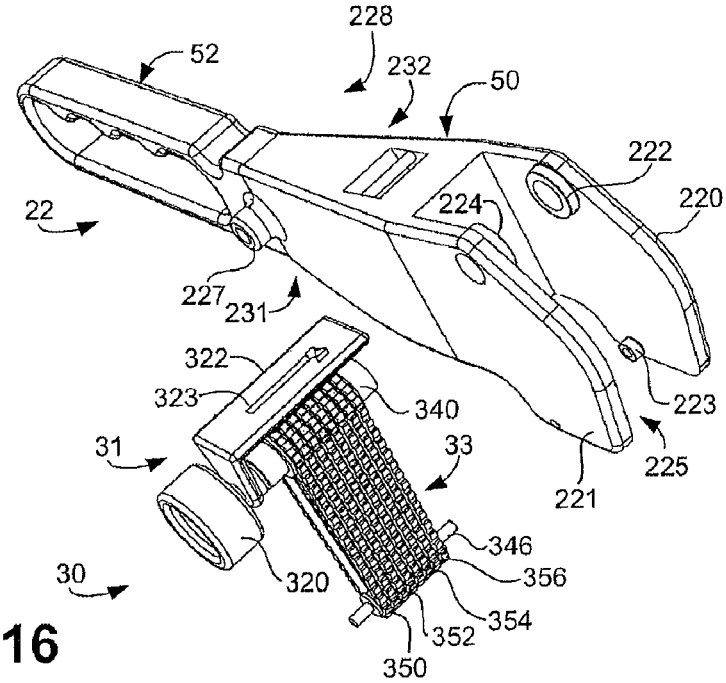
FIG. 16 is an exploded diagrammatic illustration of the trigger assembly of FIG. 15.

As best seen in FIGS. 15-16, the trigger assembly 20 generally includes a trigger handle 22 and a stamping assembly unit 30. The trigger handle 22 has a unitary construction and includes a body member 50 and a finger-engagable grip or extension 52 having integrally formed therein an elongated aperture or finger-receiving opening 54 (FIG. 20) that permits the fingers of a user to grip the extension 52 so that it may be pulled toward the trigger handle 42 of the housing 12 in a trigger-like manner.

The body member 50 as best seen in FIG. 16, includes at its distal end a pair of spaced apart stamping unit support arms 220-221, which supports the stamping assembly unit 30 therebetween. As will be explained hereinafter in greater detail, the trigger assembly 20 is supported within the housing 12 by a pair of axle nubs or pivot mounts 227 and 228 respectively disposed opposing one another on the body member 50. In this regard, the axle nubs are received with nub supports or trigger mounts 150 and 150' which are disposed at a rear portion of the housing 12. With this arrangement it should be understood by those skilled in the art, that when a user pulls the trigger extension 52 toward the housing handle 42, the trigger assembly 20 pivots about the nub supports 150 and 150' disposed within the interior of the housing 12, causing the stamping assembly unit 30 to move along an inking path best seen in FIGS. 20-22.

As will be explained hereinafter in greater detail, the trigger assembly 20 carries the stamping assembly unit 30 along the predetermined inking path, so that the stamping assembly unit 30 is brought into engagement in sequence, first with a replaceable ink cartridge assembly unit 14 that causes the stamping assembly unit 30 to be inked with a fresh supply of ink, and then next into engagement with a sleeve of an electrical conductor, such as the sleeve of the electrical conductor 11 for stamping it with customized indicia.

The handle assembly 12, supports or holds the ink cartridge assembly unit 14 in proper position so that its inking unit 18 may cooperate with the stamping assembly unit 30 as it moves alternately back and forth along the inking path under the force of the trigger assembly 20. As will be explained hereinafter in greater detail, the portable cable marking mechanism 10 is constructed or adapted so that it may be utilized to mark different gauge wires and cable types, selected from a plurality of different sized wires and cables, with customized or user selected customized indicia provided by the stamping assembly unit 30.

Figure 20:
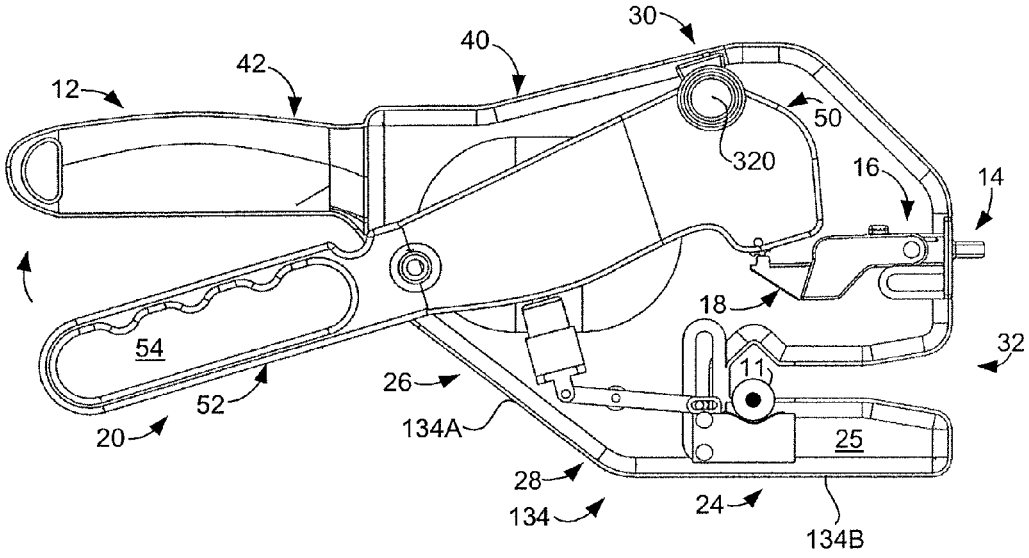
FIG. 20 is an side elevation view of the portable wire stamping gun of FIG. 1, with the left side gun handle panel removed to illustrate a starting position for loading the gun with an object to be stamped with customized indicia.

In use, a user selects a wire or cable to be marked with customized indicia, such as the cable 11, and slides the cable 11 into an indicia marking position via a electrical conductor receiving slot or passageway 32 as best seen in FIG. 20. This is a start inking position.

Next, the user grasps the gun handle 12 at about its end handle extension 42 so that the fingers of the user may grip the trigger assembly 20 in a squeezing manner so that the trigger grip 52 of the trigger assembly 20 may be pulled upwardly toward the end handle extension 42 of the handle assembly 12.

The user then using his or her other hand to hold the cable 11 in proper position within the passageway 32, and begins to pull the grip 52 of the trigger assembly 20 toward the end handle extension 42. As the grip 52 of the trigger assembly 20 is pulled toward the handle extension 42 under the finger force of the user, the stamping assembly unit 30, which is carried by the trigger assembly 20, moves in a generally downward direction so that the stamping assembly unit 30 is brought into inking engagement with the inking unit 18 as best seen in FIG. 20.

Figure 21:
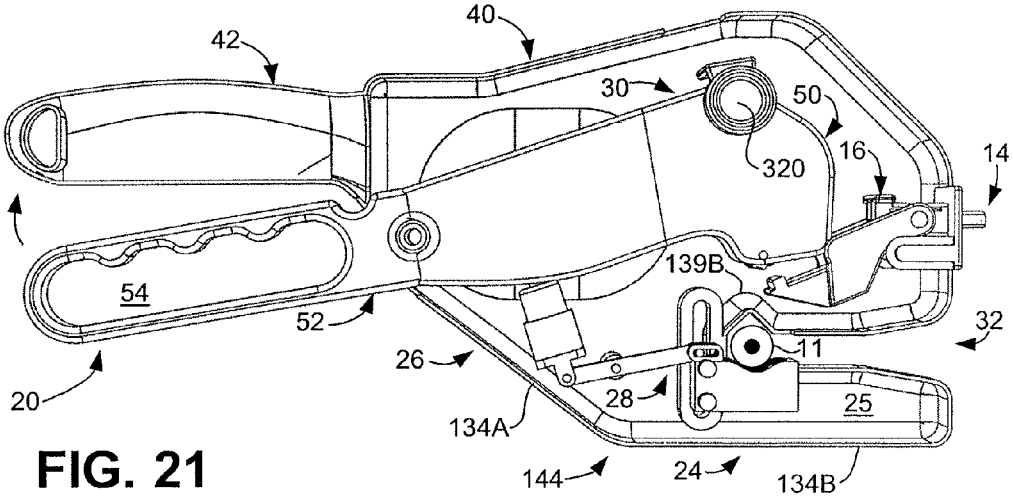
FIG. 21 is an side elevation view of the portable wire stamping gun of FIG. 1, with the left side gun handle panel removed to illustrate an intermediate position for moving the stamping assembly into position for stamping an with customized indicia.

As the user continues pulling the grip 52 of the trigger assembly 20 toward the handle extension 42, as best seen in FIG. 21, the trigger assembly 20 causes the inking unit 18 to be pivoted about its carriage unit 16, allowing the stamping assembly unit 30 to continue its downward movement toward the cable 11.

Figure 22:
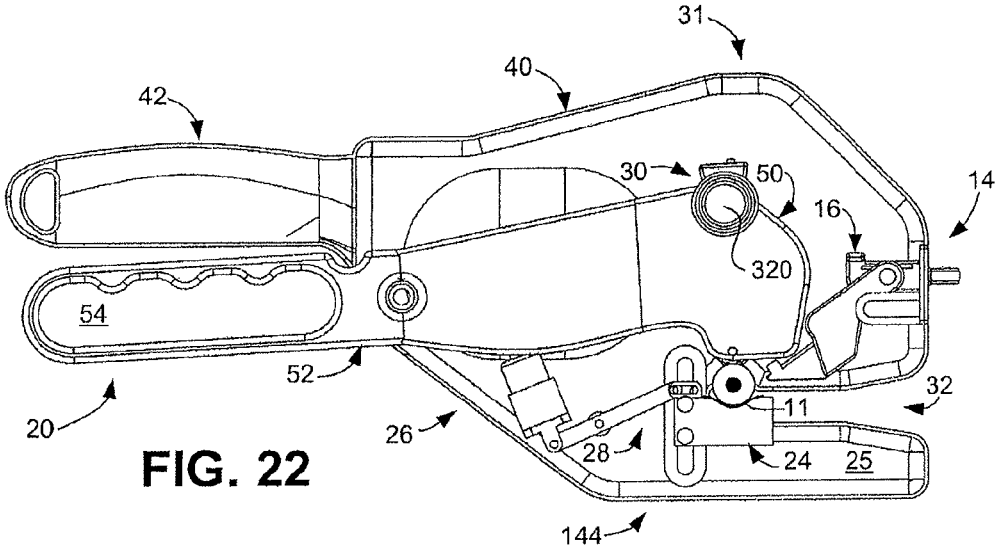
FIG. 22 is a side elevation view of the portable wire stamping gun of FIG. 1, with the left side gun handle panel removed to illustrate a stamping position for stamping an object with customized indicia.

When the grip 52 of the trigger assembly 20 is brought to its closed position, adjacent to the handle extension 42 as best seen in FIG. 22, the stamping assembly unit 30 is so positioned against the cable 11 to cause the ink bearing die or belt of the stamping assembly unit 30 to engage the cable 11 to stamp the cable 11 with the customized indicia formed by the die.

After the cable 11 has been stamped with the customized indicia, the user releases the squeezing force between the grip 52 and the handle extension 42 which allows the grip 52 of the trigger unit 20 to be returned to its starting position under the force of a compression spring assembly 26 mounted within the base unit 12.

The Ink Cartridge Assembly Unit

Considering now the ink cartridge assembly unit 14 in greater detail with reference to FIGS. 10-13, the ink cartridge assembly unit 14, generally includes the ink cartridge carriage unit 16 and the ink cartridge or inking unit 18. The ink cartridge carriage unit 16 and the inking unit 18 are coupled together and are structured so that they may be slideably mounted as a unit within the body member 40 of the housing 12. The inking unit 18 is also pivotally mounted to the ink cartridge carriage unit 16 by a pivot pin 60 which is held in place by a pair of compression springs 193 and 194 respectively. The compression springs 193 and 194 also permit the inking unit 18 to return to its normal insertion position when the inking unit 18 is not engaged by the body 50 of the trigger assembly 20.

The spring-loaded ink cartridge 18, is adapted to be carried along a rectilinear path of travel within the gun handle assembly 12 by the carriage unit 16. In this regard, the carriage unit 16 causes the ink cartridge 18 to be properly positioned for engagement with the stamping assembly unit 30 as best seen in FIG. 20.

The inking unit 18 is pivotally mounted to the ink cartridge carriage unit 16 so that it may engage the stamping assembly unit 30 at an ink transfer position (FIG. 20). As the stamping assembly unit 30 is moved from the ink transfer position, the stamping assembly unit 30 travels along a reciprocating path of travel between the ink transfer position and a stamping position and thereby causes the inking unit 18 to be moved into a pivoted retracted position as best seen in FIGS. 21-22. The movement of the inking unit 18 back to its original ink transfer position facilitates re-inking the stamping assembly unit 30. It should be noted that the ink cartridge assembly unit 14 is slideably mounted within the gun handle assembly 12 so that it may be easily and conveniently removed and replaced when the ink within the inking unit 18 has been expended from repeated use. In this regard, the ink cartridge assembly unit 14 supplies a sufficient volume of ink to the stamping assembly unit 30 to facilitate between about 500 to about 5000 customized ink stamping.

Considering now the trigger assembly 20 in greater detail with reference to FIGS. 1 and 20-22, the trigger assembly 20, is pivotally moved between a non inking position and the stamping position, under the hand gripping control of a user (not shown). In this regard, the trigger assembly 20 is pivotally moved, the trigger assembly 20 simultaneously moves, relative to one another, a cable die or gripping block 24 and the ink stamping assembly unit 30, to cause an electrical conductor disposed or positioned within or on the gripping block 24 (FIG. 22), to be marked with customized user selectable indicia provided by or transferred by the ink stamping assembly unit 30. The compression spring assembly 26 (FIG. 19), coupled between the trigger assembly 20 and the gripping block 24, by a trigger link 28 (FIG. 6), regulates the amount of gripping pressure that may be exerted on the conductor 11 by the user.

In operation, the method of using the marking mechanism 10 begins when a user selects the marks to be placed on the conductor via the stamping assembly unit 30 and then selects a wire or cable to be marked with the selected indicia, such as the cable 11. The user then causes the selected electrical conductor 11 to be placed into the handle assembly 12 via the electrical conductor receiving slot 32 so that the cable cover or sleeve comes to rest within the seat of the gripping block 24.

The user then grips the handle assembly 12 within his or her hand, placing his or her fingers within the grip 52 of the trigger assembly 20, so that the grip 52 may be pulled under finger force of the user to move the trigger assembly 20 from its resting position to its stamping position. In this manner the seated electrical conductor 11 is held in place within the gripping block 24, and is moved upwardly until it is engaged by the stamping assembly unit 30 to transfer ink arranged in the selected indicia onto the cable sleeve. After stamping the conductor 11 with the selected indicia marking, the user may easily repeat the process at another position on the conductor 11, by merely sufficiently loosening his or her grip on the trigger assembly 20 to release the conductor 11, so the electrical conductor can be pulled axially to a new marking position within the gripping block 24, and then stamped again.

The Gun Handle Assembly

Figure 8:
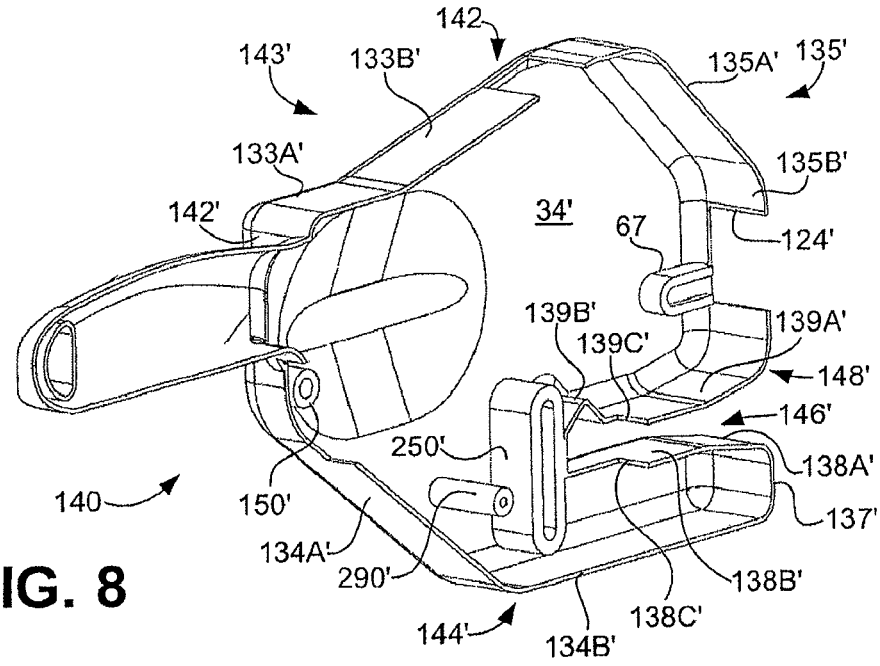
FIG. 8 is a diagrammatic illustration of a right side housing forming part of the portable wire stamping gun of FIG. 1, illustrating its inside structure.
Figure 9:
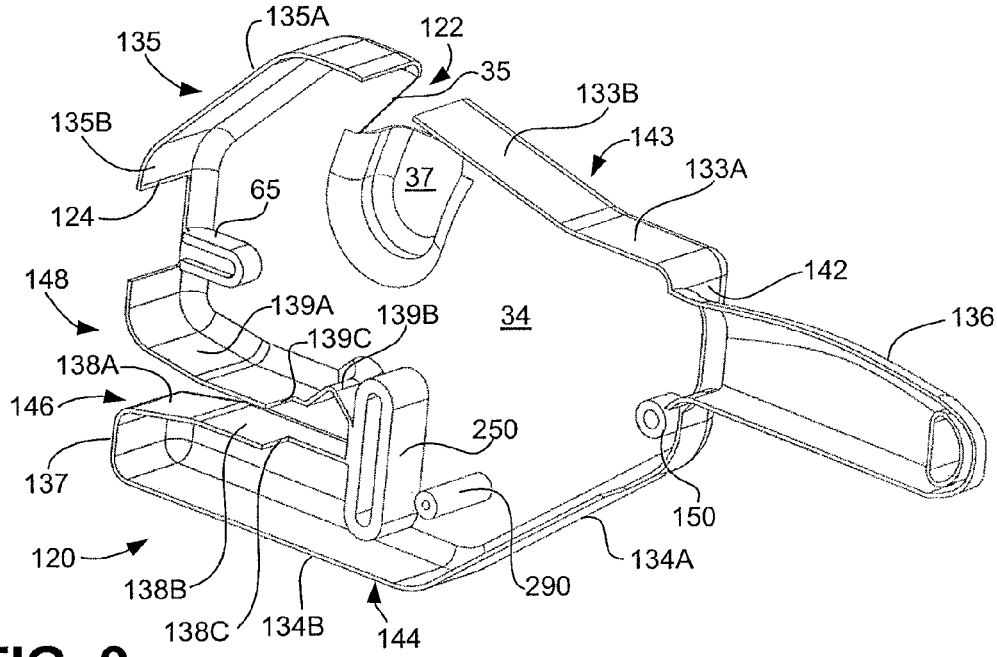
FIG. 9 is a diagrammatic illustration of a left side housing forming part of the portable wire stamping gun of FIG. 1, illustrating its inside structure
Figure 14:
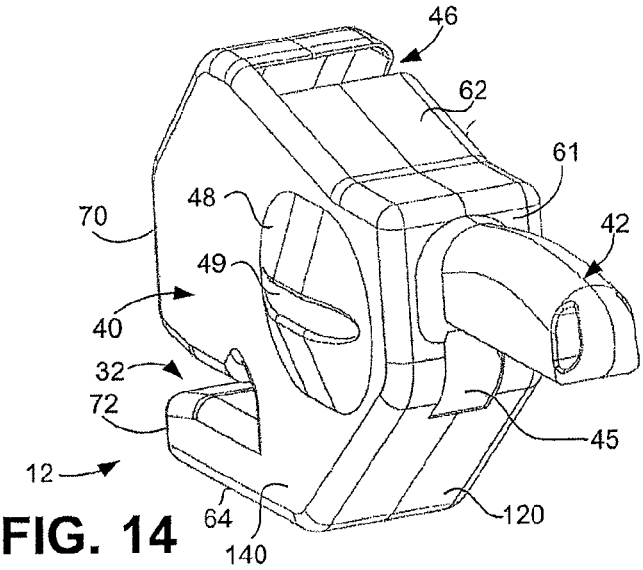
FIG. 14 is a diagrammatic illustration of the gun handle assembly of FIG. 1.

Considering now the gun handle assembly 12 in greater detail with reference to FIGS. 8-9 and 14, the gun handle assembly 12 has a modular construction which includes the body 40 and the handle 42. The body 40 generally includes a rear wall 61, a top wall 62, a bottom wall 64, a top front wall 70 and a bottom front wall 72. The top front wall 70 and the bottom front wall 72 are separated from one another by the electrical conductor guide or slot, indicated generally at 32, which is an electrical conductor receiving space defined by an intermediate top wall 74, an intermediate bottom wall 76 and a back wall 78 as best seen in FIG. 1.

The handle extension 42 extends rearwardly from the rear wall 61 as best seen in FIG. 14 and has a trigger handle access window or cutout 45 which is disposed below the handle 42. The top front wall 70 has an ink cartridge access window or cutout 44 which has a general rectangular shape. As will be explained hereinafter in greater detail, the body 40 and handle 42 are formed into a gun-like housing configuration by snapping together in a secured fixed position, a right-side handle member 120 (FIG. 9) and a left-side handle member 140 (FIG. 8).

Figure 5:
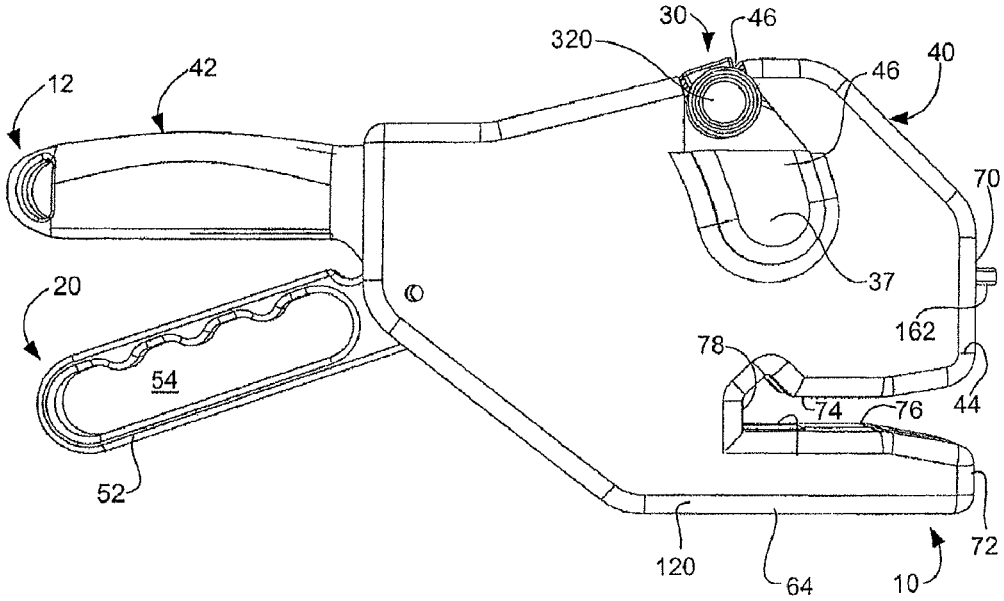
FIG. 5 is a left side elevation view of the portable wire stamping gun of FIG. 3.

The right-side handle member 120 and the left-side handle member 140 are configured to snap together to form the gun handle assembly 12 as best seen in FIG. 14. When so snapped together, the right-side handle member 120 and the left-side handle member 140 also form the ink cartridge access window 44, the rear trigger handle access window 45, a top viewing window 46 and a bottom gripping block access window 47 (FIG. 5).

Considering now the right-side handle member 120 in greater detail with reference to FIGS. 1 and 9, the right-side handle member 120 generally includes a primary support wall 34 which has extending outwardly therefrom in one direction an open boss 37. The boss 37 is in communication with the viewing window 46 and has a sufficient height dimension and a sufficient width dimension for receiving therein a control knob 320, which forms part of the stamping assembly unit 30. More particularly, the boss 37 permits the stamping assembly 30 to move in an unrestricted manner along its path of travel from its non-inking position, to its ink stamping position. The primary wall 34 also has extending outwardly therefrom in an opposite direction from the boss 37, and a set of secondary walls which define the shape of the right-side handle member 120 as best seen in FIG. 9. The set of secondary walls includes a rear wall 132, a top wall 143, a bottom wall 144, a pair of spaced apart front walls 135 and 137 respectively, and a pair of spaced apart wire guiding walls 146 and 148 respectively.

Considering the left-side handle member 140 in greater detail with reference to FIGS. 1 and 8, the left-side handle member 140 generally includes a primary wall 34' which has extending outwardly therefrom in one direction a boss 48. The boss 48 has a sufficient height dimension and a sufficient width dimension for receiving in a pen receiving slot 49 a marking pen P. The primary wall 34' also has extending outwardly therefrom, in an opposite direction from the boss 48, a set of secondary walls which define the shape of the left-side handle member 140 as best seen in FIG. 8. The set of secondary walls includes a rear wall 142', a top wall 143', a bottom wall 144', a pair of spaced apart front walls 135' and 137' respectively, and a pair of spaced apart wire guiding walls 146' and 148' respectively.

Considering the right-side handle member 120 in still greater detail with reference to FIGS. 1 and 9, the top wall 143 includes a first segment 133A and a second segment 133B. The first segment 133A is integrally connected to the rear wall 142 and is disposed at about a 90 degree angle to the rear wall 142. The first segment 133A is integrally connected at its opposite end to the second segment 133B which extends upwardly therefrom at a slightly inclined angle. A right-side viewing window cutout 122 is disposed in the second segment 133B which forms part of the top viewing window 46. A primary wall cutout 35 is in communication with the top viewing window cutout 122 and extends to the top of the open boss 37 providing further access for the control knob 320.

As best seen in FIGS. 1 and 9, the front wall 135 generally includes a top front wall segment 135A and a bottom front wall segment 135B. The top front wall segment 135A is integrally connected to one end of the wall segment 133B and extends downwardly therefrom at a slightly inclined angle. The opposite end of the top front wall segment 135A is integrally connected to the bottom front wall segment 135B, which is substantially parallel with the rear wall 142. An ink cartridge receiving cutout 124 is disposed in the bottom front wall segment 135B to help form the ink cartridge access window 44.

The opposite end of the bottom front wall segment 135B is integrally connected to a front segment 139A of the cable guide wall 148 which extends rearwardly therefrom at about 90 degrees. The opposite end of the front segment 139A is integrally connected via an access block cutout or window 139C to a rear segment 139B of the cable guide wall 148. The rear segment 139B is configured as an inverted V and is integrally connected at its distal end to an upper portion of an upstanding elongated access block guide 250 which extends outwardly from the primary support wall 34. The access block guide 250 cooperates with an opposing access block guide 250' disposed on the left-side handle member 140 to capture the gripping block 24 and thus, defining its path of travel within the interior of the housing 12.

Considering now the bottom wall 144 of the right-side handle member 120 in greater detail with reference to FIG. 9, the bottom wall 144 generally includes a rear bottom wall segment 134A and a front bottom wall segment 134B. The rear bottom wall segment 134A is integrally connected to the rear wall 142 and extends forwardly and downwardly therefrom at a slight inclined angle. The opposite end of the rear bottom wall segment 134A is integrally connected to the front bottom wall segment 134B which is a base segment for allowing the mechanism 10 to stand upright when resting on a stationary flat surface, such as a workbench.

The opposite end of the front bottom wall segment 134B is integrally connect to the front wall 137 which extends upwardly therefrom at about 90 degrees. The bottom front wall 137 and the top front wall 135 are slightly spaced apart from one another for helping to define the cable or wire access guide or slot 32 which is further defined by the wire access guide walls 146 and 148 respectively.

Considering now the wire guide wall 146 in greater detail with reference to FIGS. 1 and 9, the wire guide wall 146 generally includes a front segment 138A and a rear segment 138B. The front segment 138A is integrally connected at one of its ends to the top of the bottom front wall 137 and extends rearwardly therefrom in a generally parallel manner to the front bottom segment 134B of the bottom wall 144. The opposite end of the front segment 138A is integrally connected to the rear segment 138B which is connected at its opposite end to a bottom portion of the access block guide 250. An access block cutout or window 138C is disposed in the rear segment 138B to help define the gripping block access window 47.

From the forgoing, it should be understood by those skilled in the art that the bottom wall 144, the front wall 137, and the wire guide wall 146 help define a gripping block receiving space 25. The gripping block receiving space 25 has sufficient height, width and depth dimensions for receiving therein the gripping block 24.

Considering the left-side handle member 140 in still greater detail with reference to FIGS. 1 and 8, the top wall 143' includes a first segment 133A' and a second segment 133B'. The first segment 133A' is integrally connected to the rear wall 142' and is disposed at about a 90 degree angle to the rear wall 142'. The first segment 133A' is integrally connected at its opposite end to the second segment 133B' which extends upwardly therefrom at a slightly inclined angle. A left-side viewing window cutout 142 is disposed in the second segment 133B' which forms part of the top viewing window 46.

As best seen in FIGS. 1 and 8, the front wall 135' generally includes a top front wall segment 135A' and a bottom front wall segment 135B'. The top front wall segment 135A' is integrally connected to one end of the second segment 133B' and extends downwardly therefrom at a slightly inclined angle. The opposite end of the top front wall segment 135A' is integrally connected to the bottom front wall segment 135B', which is substantially parallel with the rear wall 142'. A left-side ink cartridge receiving cutout 124' is disposed in the bottom front wall segment 135B' to help form the ink cartridge access receiving window or cutout 44.

The opposite end of the bottom front wall segment 135B' is integrally connected to a front segment 139A' of the cable guide wall 148' which extends rearwardly therefrom at about 90 degrees. The opposite end of the front segment 139A' is integrally connected via an access block cutout 139C' to a rear segment 139B' of the cable guide wall 148'. The rear segment 139B' is configured as an inverted V and is integrally connected at its distal end to an upper portion of an upstanding elongated access block guide 250' which extends outwardly from the primary support wall 34'. The access block guide 250' cooperates with the opposing access block guide 250 disposed on the right-side handle member 120 to capture the gripping block 24 and thus, defining its path of travel within the interior of the base unit housing 12.

Considering now the bottom wall 144' of the left-side handle member 140 in greater detail with reference to FIG. 8, the bottom wall 144' generally includes a rear bottom wall segment 134A' and a front bottom wall segment 134B'. The rear bottom wall segment 134A' is integrally connected to the rear wall 142' and extends forwardly and downwardly therefrom at a slight inclined angle. The opposite end of the rear bottom wall segment 134A' is integrally connected to the front bottom wall segment 134B' which is a base segment for allowing the mechanism 10 to stand upright when resting on a stationary flat surface, such as a workbench.

The opposite end of the front bottom wall segment 134B' is integrally connect to the bottom front wall 137' which extends upwardly therefrom at about 90 degrees. The bottom front wall 137' and the top front wall 135' are slightly spaced apart from one another for helping to define a cable or wire access guide or slot which is further defined by the wire access guide walls 146' and 148' respectively.

Considering now the wire guide wall 146' in greater detail with reference to FIGS. 1 and 9, the wire guide wall 146' generally includes a front segment 138A' and a rear segment 138B'. The front segment 138A' is integrally connected at one of its ends to the top of the bottom front wall 137' and extends rearwardly therefrom in a generally parallel manner to the front bottom wall segment 134B' of the bottom wall 144'. The opposite end of the front segment 138A' is integrally connected to the rear segment 138B' which is connected at its opposite end to a bottom portion of the access block guide 250'. An access block cutout or window 138C' is disposed in the rear segment 138B' to help define the gripping block access window 47.

Figure 11:
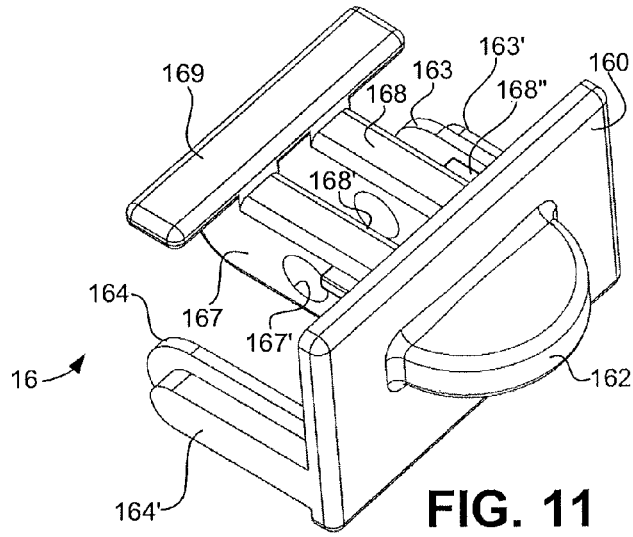
FIG. 11 is a diagrammatic illustration of an ink cartridge carrier unit which forms part of the ink cartridge assembly of FIG. 10.
Figure 12:
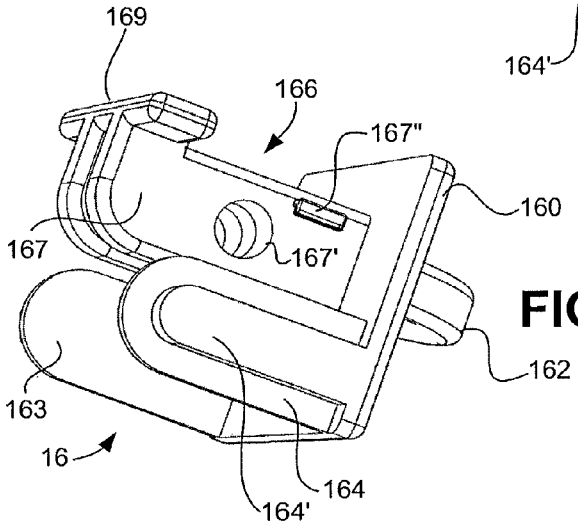
FIG. 12 is another diagrammatic illustration of the ink cartridge carrier unit of FIG. 11.

Considering now the ink cartridge carriage unit 16 in greater detail with reference to FIGS. 10-12, the ink cartridge carriage unit 16 generally includes a front wall 160 which is dimensioned to be received within the ink carriage cutout 44 disposed in the front wall of the housing 12. The front wall 160 has extending outwardly from its outside facing surface at about a ninety degree angle a finger-engagable tab 162. The tab 162 has a sufficient surface area to enable a user to grasp the tab 162 to hold the ink cartridge assemble 14 in position for insertion into the gun housing 12.

Extending inwardly and away from the inside surface of the wall 160 at about a ninety degree angle are a pair of spaced apart track walls 163 and 164 which have upstanding tracks 163' and 164' respectively. The track 163' and 164' are dimensioned to be received within tracks 65 and 67 respectively which are disposed in the left-side handle member 120 and the right-side handle member 140 respectively.

Also extending inwardly and away from the inside surface of the front wall 160 at about a ninety degree angle is a support bar indicated generally at 166 having a pair of pin support members or arms 167 and 168. A stop bar 169 is supported at about the distal ends of the pin support members 167 and 168 in a generally perpendicular manner. Pivot pin openings or apertures 167' and 168' are disposed in respective ones of the support members 167 and 168. The apertures 167' and 168' are dimensioned for receiving therein the pivot pin 60.

As best seen in FIG. 10-12, the pin support arms 167 and 168 have disposed on there outside surfaces spring catches 167" and 168" respectively. The spring catches 167" and 168" are disposed to capture and hold in place the ends portions of the compression springs 193 and 194 respectively as best seen in FIG. 10. A corresponding set of spring catches 183" and 184" (FIG. 13) are disposed on the inking unit 18 as will be explained hereinafter in greater detail. The spring catches 183" and 184" are disposed to capture the opposite ends of the compression springs 193 and 194 respectively. In the manner, the compression springs 193 and 194 are held in place between the two body members 16 and 18 of the ink cartridge assembly 14 allowing the two members 16 and 18 to be held in tension relative to one another so the inking unit 18 when released from the body member 50 will return to its starting position as best seen in FIG. 20.

Figure 13:
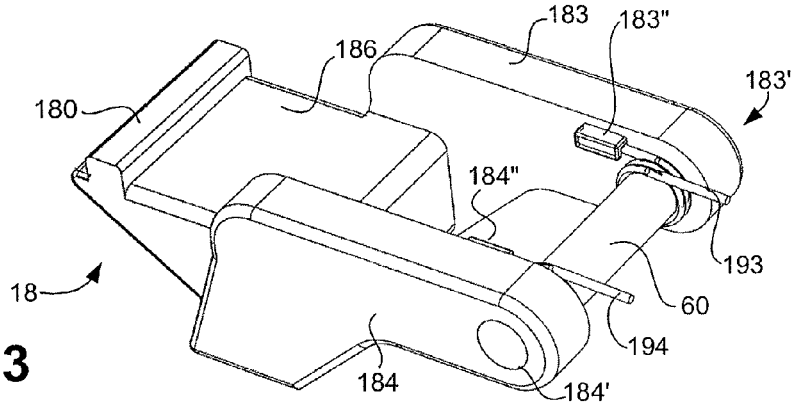
FIG. 13 is a diagrammatic illustration of an inking unit which forms part of the ink cartridge assembly of FIG. 10.

Considering now the inking unit 18 in greater detail with reference to FIG. 13, the inking unit 18 is a hollow body member having a ink holding space for storing a sufficient volume of ink to affect between about 500 to 5000 inkings. A suitable ink for storage and inking a conductor sleeve is substantially the same as that ink provide in a conventional pen. For example, the ink in a Sanford-Sharpie Fine Point Permanent Marker, Black Pen, identified by material safety data sheet NSN: 752000N032860 Manufacturer's CAGE: 86874, Part No. Indicator: B, Part Number/Trade Name: Sharpie Fine Point Permanent Marker, Black as sold by Sanford Corporation located at 2740 Washington Blvd, Bellwood, Ill., US 60104.

As best seen in FIG. 13, the inking unit 18 generally includes the pair of spaced apart outer pin support arms 183 and 184 respectively. A pair of pivot pin openings or apertures 183' and 184' is disposed at about the proximal end of respective ones of the support arms 183 and 184. The apertures 183' and 184' are dimensioned for receiving therein the pivot pin 60 and are aligned so that when the ink cartridge carriage unit 16 and the inking unit 18 are coupled together to have a corresponding alignment with the apertures 163' and 164'. In this manner the pivot pin 60 can be received and supported within the respective ones of the apertures 163', 183', 184' and 164' to couple the ink cartridge carriage unit 16 and the inking unit 18 removably together.

An ink storage unit or ink storage reservoir 186 is integrally connected between the distal ends of the support arms 183 and 184 and is in fluid communication with an ink pad or bar 180. The ink storage unit 186 has a body width dimension, height dimension and length dimension which are configured in somewhat triangular shape when viewed from a side elevational perspective. A substantial portion of the ink reservoir 186 extends beyond the distal ends of the support arm 183 and 184 respectively. At the apex end A of the ink reservoir 186 is the elongated inking bar 180. In this regard, the inking bar 180 has a sufficient length to support from below the entire width dimension of the belt assembly dies. In this manner all of the belts in the belt assembly 33 may be simultaneously inked from the inking bar 180. It should be noted that the transfer of ink from the ink pad 180 to the stamping assembly unit 30 provides a sufficient amount of ink to facilitate between 1 to 5 stamping operations before the user will need to sufficiently release his or her grip on the trigger assembly 20 so that additional ink may be transferred from the inking pad 180 to the stamping assembly unit 30.

As best seen in FIG. 10, when the ink cartridge carriage unit 16 and the inking unit 18 are coupled together and supported as a unit by the pivot pin 60, the track walls 163 and 164 of the carriage unit 16 are disposed outwardly of the support arms 183 and 184 of the inking unit 18, thereby allowing the inking unit 18 to pivot downwardly unobstructedly between the track walls 163 and 164 of the ink carriage unit 16. Also as best seen in FIG. 10, the stop bar 169 is disposed above the inking unit 18 so that the stop bar 169 is able to engage the support arms 183 and 184 thereby helping to retain the tension between the ink cartridge carriage unit 16 and the inking unit 18 caused by the compression springs 193 and 194 respectively.

Figure 17:
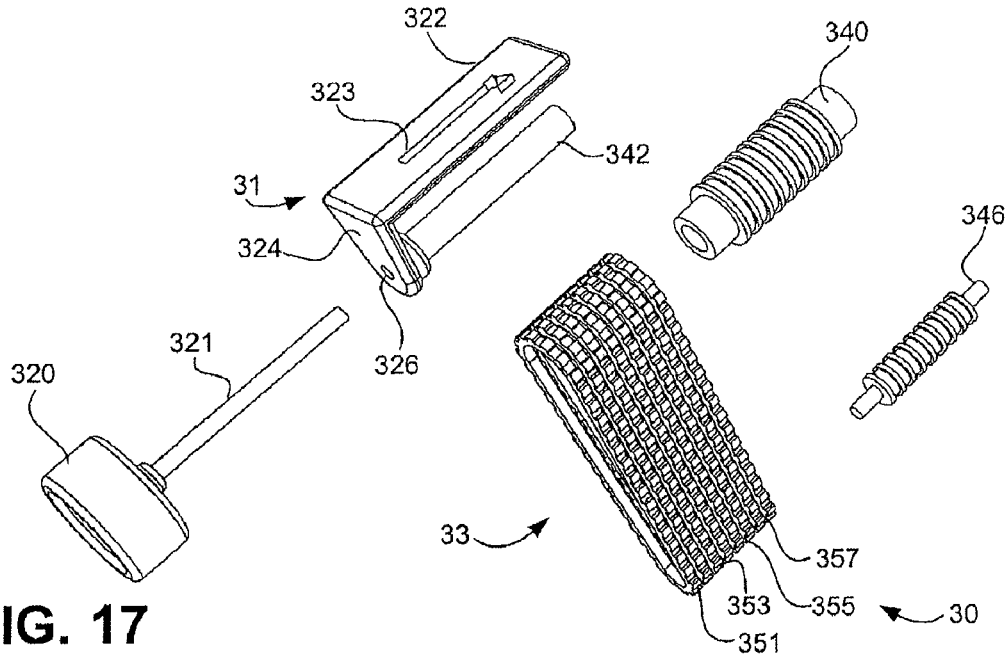
FIG. 17 is an exploded diagrammatic illustration of a stamping assembly forming part of the trigger assembly of FIG. 15.

Considering now the trigger assembly 20 in greater detail with reference to FIGS. 15-17, the trigger handle 22 includes a pair of spaced apart support members 220 and 221 respectively, which are disposed at a front portion of the trigger handle 22. A set of axle capturing boss members 222 and 223 are disposed on support member 220, while a complementary set of axle capturing boss member 224 and 225 are disposed on support member 221. The axle capturing boss members 222 and 224 are large upper boss members and are disposed opposite one another to facilitate securing and supporting therein for rotational movement a large roller 340 that forms part of the stamping assembly unit 30. In a similar manner, the axle capturing boss members 223 and 225 are small lower boss members and are disposed opposite one another to facilitate securing and supporting therein for rotational movement a small roller 346 that forms part of the stamping assembly unit 30. An axle access aperture 226 is disposed opposite the capturing boss member 224 so that a large roller axle 342 may pass therethrough and be captured between the capturing boss members 222 and 224 respectively.

In order to permit the trigger assembly 20 to be pivotally mounted within the gun handle housing 12, the trigger handle 22 includes a pair of spaced apart pivot mounts 227 and 228 which are mounted opposite one another at a rear portion of the body member 50 as best seen in FIG. 16. The pivot mounts 227 and 228 are captured within axle nub support members 150 and 150' respectively which extend outwardly from support walls 34 and 34' respectively.

To help control the movement of stamping assembly unit 30, relative to the gripping block 24, the trigger assembly 30 is coupled or linked to the gripping block 24 by a compression spring assembly 26 (FIG. 18) and trigger link 28. To facilitate mounting the compression spring assembly 26 to the trigger assembly 30, the body member 50 of the trigger assembly 30 includes a pair of spaced apart compression spring capture members 231 and 232 (FIG. 16) that are configured to capture between them a top part of the compression spring assembly 26 as will be explained hereinafter in greater detail.

The Stamping Unit

Considering now the stamping assembly unit 30 in greater detail with reference to FIGS. 16-17, the stamping assembly unit 30 generally includes a viewing window assembly 31 and a belt assembly 33 that cooperate with one another to allow a user to select customized indicia for stamping the sleeve of the cable 11. As noted earlier, the stamping assembly unit 30 is carried by the trigger assembly 20 and is pivotally mounted for movement along a cable stamping path between a starting non-inking position, to an intermediate inking position, and to a final stamping position.

Considering now the viewing window assembly 31 in greater detail with reference to FIGS. 16-17, the viewing window assembly 31 generally includes a viewing window 322 having integrally attached thereto an axle support 324 which depends therefrom at about 90 degrees. An elongated window 323 is provided in the viewing window 322 to provide the user visual access to the customized indicia settings provided by the belt assembly 33. The axle support 324 has a control knob access aperture 326 disposed at about it distal end which is dimensioned for receiving therein a control knob axle 321.

Considering now the belt assembly 33 in greater detail with reference to FIGS. 16-17, the belt assembly 33 generally includes the large roller 340 and the small roller 346 which have disposed thereon a set of indicia belts 350-357. As noted earlier the large roller 340 and small roller 346 are supported for rotational movement between the support arms 220 and 221 of the trigger body 50. The belts 350-357, which are slightly contoured, are held in place on the rollers 340 and 346 by a set of valley and ridge members disposed on the respective rollers. The belts 350-357 contain customized indicia or numerical character indicia dies which allow the transfer of ink to a round or flat surface.

In operation, a user by rotating the control know 320 can capture individual ones of the belts and then by rotating the control knob each captured and selected belt may be rotated until desired indicia disposed on the belt is disposed in the viewing window 323. In this regard, when a desired indicia is disposed in the viewing window 323, a corresponding indicia die is disposed at the opposite end of the belt in proper position for inking and transferring the selected customized indicia to a cable sleeve when the trigger assembly 20 is moved for stamping purposes.

The Compression Spring Assembly

Figure 18:
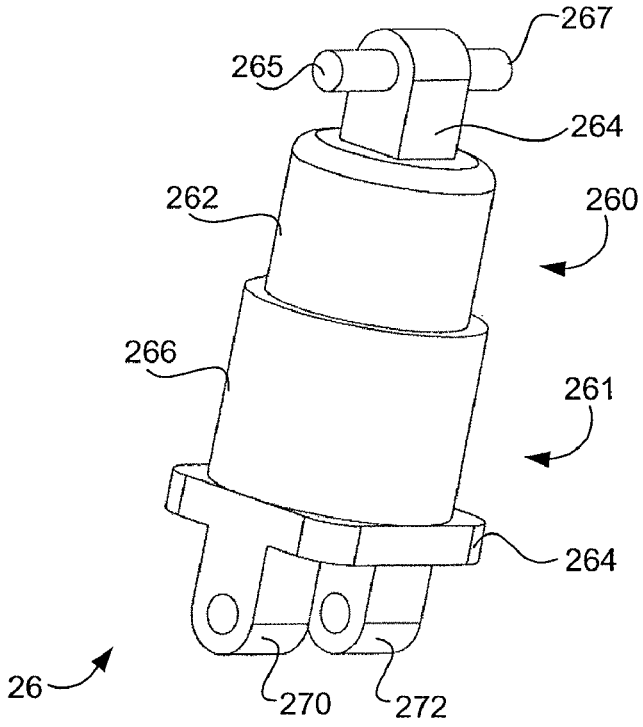
FIG. 18 is a diagrammatic illustration of a compression spring assembly forming part of the portable wire stamping gun of FIG. 1.
Figure 19:
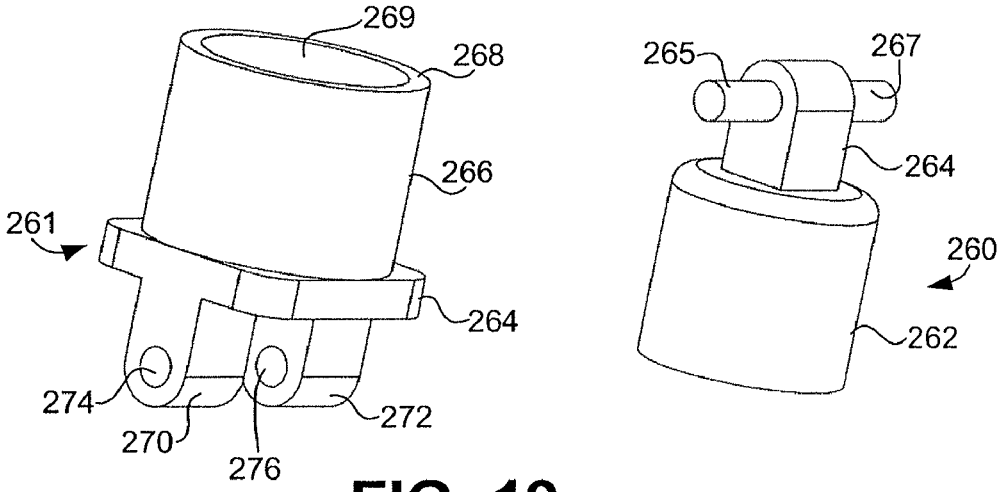
FIG. 19 is an exploded diagrammatic illustration of the compression spring assembly of FIG. 18.

Considering now the compression spring assembly 26 in greater detail with reference to FIGS. 18-19, the compression spring assembly 26 generally includes an upper compression spring member 260 and a lower compression spring member 261. The upper compression spring member 260 is adapted to be coupled to the trigger assembly 20 as previously described and to be received within a lower compression spring member 261. The lower compression spring member 261 is adapted to be coupled to the gripping block 24 by the trigger link 28.

As best seen in FIG. 19, the upper compression spring member 260 includes a cylindrical base 262 which is dimensioned to be received within a spring chamber 269 of the lower compression spring member 261. A coupler or base member 264 having a pair of oppositely disposed coupling pins 265 and 267 respectively is integrally connected to the base 262 and extends axially upwardly therefrom. The coupling pins 265 and 267 are dimensioned to be received and secured to the body 50 of the trigger assembly 30.

The lower compression spring member 26' generally includes the coupler 264 having a pair of spaced apart downwardly depending support arms 270 and 272 respectively. Linking apertures 274 and 276 are disposed within support arms 270 and 272 respectively and are dimensioned for receiving and securing therein one end of the trigger link 28. A capture cylinder 266 is integrally connected to the coupler 264 and extends axially upwardly therefrom. A cylindrical wall 268 defines the spring chamber 269 which is adapted to receive therein the base 262 of the upper compression spring member 260.

The Trigger Link

Figure 6:
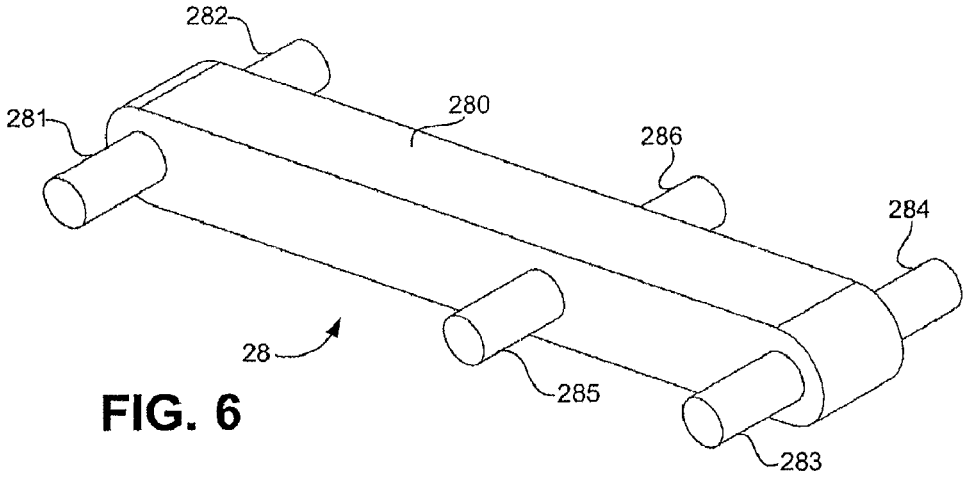
FIG. 6 is a diagrammatic illustration of a linking unit forming part of the portable wire stamping gun of FIG. 1.

Considering now the trigger link 28 in greater detail with reference to FIG. 6, the trigger link 28 generally includes an extension bar 280 having a set of compression spring coupling pins 281 and 282 respectively are disposed at one of its ends and a set of gripping block coupling pins 283 and 284 respectively are disposed at its opposite end. A pair of mounting pins 285 and 286 respectively is disposed between the set of compression spring coupling pins 281, 282 and the set of gripping block coupling pins 283, 284. The mounting pins 285 and 286 are adapted to be received within trigger link support posts 290 and 290' which extend outward from the primary support walls 34 and 34' respectively. The compression spring coupling pins 281 and 282 are adapted to be secured and received within the trigger link apertures 274 and 276 respectively of the compression spring assembly 26, while the gripping block coupling pins a 283 and 284 are adapted to be secured and received with the trigger link apertures 247 and 248 of the gripping block 24.

The Gripping Block Die

Figure 7:
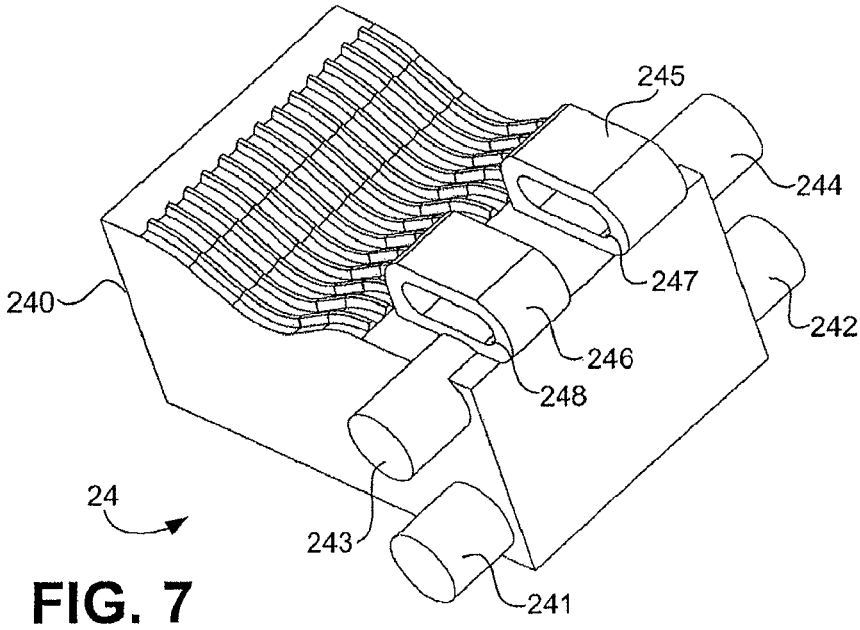
FIG. 7 is a diagrammatic illustration of an clamping block forming part of the portable wire stamping gun of FIG. 1.

Considering now the gripping block or die 24 in greater detail with reference to FIG. 7, the gripping block 24 generally includes a block member 240 having disposed at its rear end a set of guide posts 241-244 which are adapted to be received within the guides 250 and 250' respectively. Integrally connected to the block member above and between the guide posts 241-244 are a set of trigger link aperture posts 245 and 246 respectively. The link aperture posts 245 and 246 are provided with apertures 247 and 248 respectively which are dimensioned for securing and receiving therein the gripping block coupling pins 283 and 284 disposed on the trigger link 28.

Figure 23:
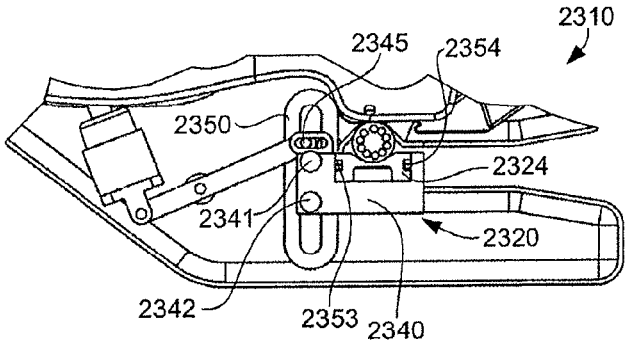
FIG. 23 is a cut-away side elevation view of a portable cable marking mechanism which is constructed in accordance with another preferred embodiment of the present invention.
Figure 24:
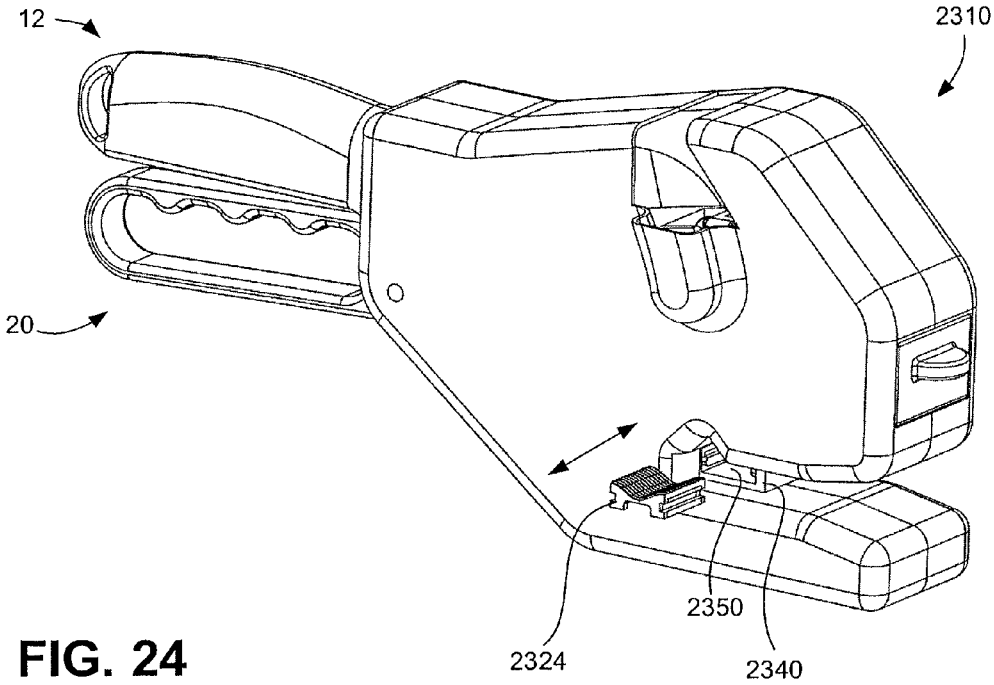
FIG. 24 is a diagrammatic view of the portable cable marking mechanism of FIG. 23, illustrating the insertion of its reversible clamping block die.
Figure 25:
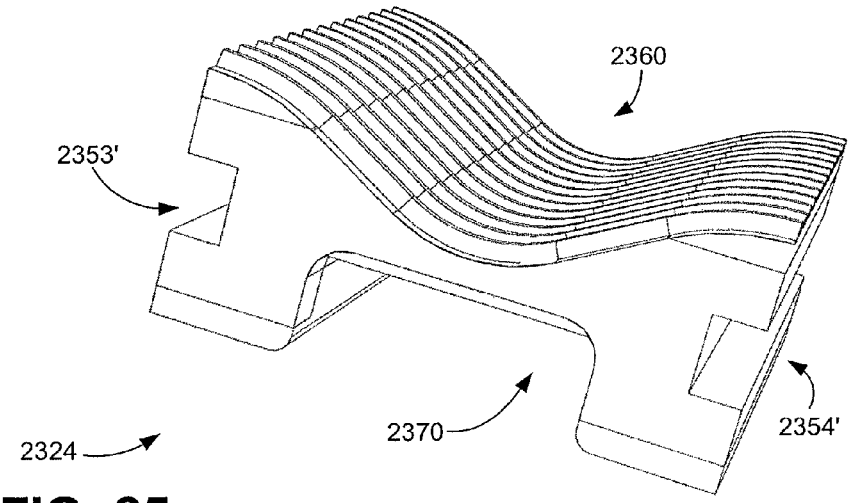
FIG. 25 is an enlarged diagrammatic illustration of the reversible clamping block die of FIG. 24.

Referring now to the drawings and more particularly to FIGS. 23-25 there is illustrated another portable electrical conductor stamping gun 2310 which is constructed in accordance another preferred embodiment of the present invention. The portable electrical conductor stamping gun 2310 is substantially similar to the portable electrical conductor stamping gun 10 except for the structure of its gripping block or die 2324. Because the other component parts of the stamping gun 2310 are substantially identical to the component parts of the stamping gun 10, they will not be described hereinafter in greater detail.

Considering now the gripping block or die 2324 in greater detail with reference to FIGS. 23-25, the gripping block 2324 forms part of a gripping block assembly 2320. The gripping block assembly 2320 generally includes a die holder or block member 2340 having disposed at its rear end a set of guide posts, such as the guide 2341-2342 which are adapted to be received within a pair of the guides, such as the guide 2350. Integrally connected to the block member 2340 above and between the guide posts 2341-2342 are a set of trigger link aperture posts, such as the trigger link aperture post 2345. The trigger link aperture posts 2345 are provided with apertures in the same manner as the trigger link aperture post 245 and according will not be described in greater detail, except to mention that they are dimensioned for securing and receiving therein the gripping block coupling pins in the same manner as the coupling pins 283 and 284 previously described relative to the trigger link 28.

Considering the block member 2340 in still greater detail, the block member has a block shape with a centrally disposed cutout 2350 that is dimensioned for receiving therein the gripping block 2324. In this regard, in order to hold the gripping block 2324 in place within the block member 2340, a set of guides are disposed within the cutout 2350, which includes a pair of elongated wall guides 2353 and 2354 respectively. The guides 2353-2354 are arranged to be received within a corresponding set of tracks 2353'-2354' disposed in the gripping block 2324 as best seen in FIG. 25.

Considering now the gripping block 2324 in greater detail with reference to FIG. 25, the gripping block 2324 is a reversible gripping block. In this regard, when disposed in a first orientation, a rounded cable or wire support groove 2360 is exposed and is available for supporting from below rounded or circularly wires and cable. When the gripping block 2324 is disposed in a second orientation a rectangular or square cable or wire support groove 2370 is exposed and is available for supporting from below a square or rectangularly shaped wires and cable.

In use, when a user squeeze the trigger 20 of the gun 10, the die holder 2340 is elevated into the wire slot at a sufficient height so that the die 2324 can be disengaged from the holder 2340 by sliding out of the holder 2340 as best seen in FIG. 24. The die 2324 may then be reversed into a desired orientation so either the curve gripping surface 2360 will be disposed or the square gripping surface 2370 will be exposed and then the die 2334 is slide back into the holder 2340. Once the die 2324 is positioned within the holder 2340, the trigger may be release allowing the die holder 2340 to be retracted into a resting position so that the exposed die 2324 may now receive and support from below a desired cable or wire of the selected shape.

It is noted that the preferred embodiments of the present invention described herein in detail for exemplary purposes is of course subject to many different variations in structure, design, application and methodology. Because many varying and different embodiments may be made within the scope of the inventive concept(s) herein taught, and because many modifications may be made in the embodiments herein detailed in accordance with the description requirements of the law, it is to be understood that the details herein are to be interpreted as illustrative and not in a limiting sense.

REFERENCE CHARACTER LIST

10 a portable electrical conductor marking mechanism or apparatus
11 reserved
12 a gun-like base unit housing or handle assembly
13 reserved
14 an ink cartridge assembly unit (16, 18)
15 reserved
16 an ink cartridge carriage unit
17 reserved
18 an ink cartridge or inking unit
19 reserved
20 a trigger assembly (22, 30)
21 reserved
22 a trigger handle
23 reserved
24 a gripping block or die
25 reserved
26 a compression spring assembly
27 reserved
28 a trigger link
29 reserved
30 a stamping unit assembly
31 a viewing window assembly
32 an electrical conductor receiving slot
33 a die or indicia belt assembly
34 a right-side primary support wall (a left-side primary support wall 34')
35 a primary wall cutout
36 reserved
37 a pen boss
38 reserved
39 reserved
40 a body member
41 reserved
42 a handle or end handle extension
43 reserved
44 an ink cartridge access window or cutout
45 a trigger handle access window or cutout
46 a top viewing window
47 a bottom gripping block access window
48 a boss
49 a pen receiving slot
50 a body member
51 reserved
52 a finger-engagable grip or extension
53 reserved
54 a finger-receiving opening or aperture
60 a pivot pin
61 a rear wall
62 a top wall
63 reserved
64 a bottom wall
65 a track
66 reserved
67 a track
68 reserved
69 reserved
70 a top front wall
72 a bottom front wall
74 an intermediate top wall
76 an intermediate bottom wall
78 a back wall
120 a right-side handle member
122 a right-side viewing window or cutout
124 a right-side cartridge window or cutout (left-side 124')
133A a first segment (left-side 133A')
133B a second segment (left-side 133B')
134A a bottom wall segment (left-side 134A')
134B a front bottom wall segment (left-side 134B')
135 a top front wall (left-side 135')
135A a top front wall segment (left-side 135A')
135B a bottom front wall segment (left-side 135B')
137 a bottom front wall (left-side 137')
138A a front segment (left-side 138A')
138B a rear segment (left-side 138B')
138C an access block cutout or window (left-side 138C')
139A a front segment (left-side 139A')
139B a rear segment (left-side 139B')
139C an access block cutout or window (left-side 139C')
140 a handle member (left-side 140')

142 a rear wall (left-side 142')
143 a top wall (left-side 143')
144 a bottom wall (left-side 144')
146 a wire guide wall (left-side 146')
148 a wire guide wall (left-side 148')
150 an axle nub support (left-side 150')
160 a front wall
162 a finger-engagable tab
163 a track wall (163' a track)
164 a track wall (164' a track)
166 a support bar
167 a pin support arm or member (167' a pivot pin opening or aperture, 167" catch)
168 a pin support arm or member (168" a pivot pin opening or aperture, 168" catch)
169 a stop bar
180 an inking bar or pad
183 an outer pin support arm (183' pivot pin opening, 183" a spring catch)
184 an outer pin support arm (184' pivot pin opening, 184" a spring catch)
186 an ink storage reservoir
193 a compression spring
194 a compression spring
220 a stamping unit support arm
221 a stamping unit support arm
222 an axle capturing boss member
223 an axle capturing boss member
224 an axle capturing boss member
225 an axle capturing boss member
226 an axle access aperture
227 a pivot mount
228 a pivot mount
231 a compression spring capture member
232 a compression spring capture member
240 a block member
241 a guide post
242 a guide post
243 a guide post
244 a guide post
245 a post
246 a post
247 an aperture
248 an aperture
250 an access block guide (left-side 250')
260 an upper compression spring member
261 a lower compression spring member
262 a cylindrical base member
264 a coupler
265 a coupling pin
266 a cylinder
267 a coupler pin
268 a wall
269 a spring chamber
270 a support arm
272 a support arm
274 an aperture
276 an aperture
280 an extension bar
281 a coupling pin
282 a coupling pin
283 a coupling pin
284 a coupling pin
285 a mounting pin
286 a mounting pin
290 a trigger link support post (290' a trigger link support post)
320 a control knob
321 a control knob axle
322 a viewing window
323 a window
324 an axle support
326 a control knob access aperture
2310 a portable electrical conductor stamping gun
2320 a gripping block assembly
2324 a die
2340 a die holder
2341 a guide post
2342 a guide post
2345 an aperture post
2350 a guide
2353 a wall guide (2353' a track)
2354 a wall guide (2354' a track)
2360 a groove
2370 a groove

The invention claimed is:

1. An expendable ink cartridge for a hand held printing mechanism, comprising:

a hollow housing for holding a reservoir of ink, the hollow housing having a pair of support arms extending outwardly from the housing;

an ink cartridge carriage unit having a pair of support arms positioned between the pair of support arms of the hollow housing, wherein a hole extends through each of the support arms of the ink cartridge carriage unit;

a pin positioned between and connecting the pair of support arms of the hollow housing, the pin extending through the hole in each of the support arms of the ink cartridge carriage unit such that the hollow housing and the ink cartridge are pivotably coupled to one another;

a stop bar positioned on the pair of support arms of the ink cartridge carriage unit and over the pair of arms of the hollow housing; and a wicking bar formed within said housing and having a sufficient width to engage individual ones of a plurality of different size and gauge electrical conductors for inking with customized indicia.

2. The expendable ink cartridge according to claim 1, wherein said reservoir of ink has a sufficient volume capacity to affect between about 500 to 5000 conductor sleeve inkings.

3. The expendable ink cartridge according to claim 2, wherein said reservoir of ink has a sufficient volume capacity to affect about 3000 conductor sleeve inkings.

4. The expendable ink cartridge according to claim 1, wherein said ink cartridge is a spring-loaded ink cartridge.

* * * * *